US008707481B1

(12) United States Patent
Juarez

(10) Patent No.: US 8,707,481 B1
(45) Date of Patent: Apr. 29, 2014

(54) EXTREMITY WARMING BLANKET

(76) Inventor: Saul Fernandez Juarez, San Jose, CA (US)

( * ) Notice: Subject to any disclaimer, the term of this patent is extended or adjusted under 35 U.S.C. 154(b) by 0 days.

(21) Appl. No.: 13/311,508

(22) Filed: Dec. 5, 2011

Related U.S. Application Data

(60) Provisional application No. 61/419,837, filed on Dec. 5, 2010.

(51) Int. Cl.
*A47G 9/00* (2006.01)

(52) U.S. Cl.
USPC ..... 5/494; 5/482; 5/484; 2/69.5; 2/69

(58) Field of Classification Search
USPC ..... 5/494, 485, 482; 2/69, 69.5
See application file for complete search history.

(56) References Cited

U.S. PATENT DOCUMENTS

| | | | | |
|---|---|---|---|---|
| 4,932,077 | A * | 6/1990 | Dobbs | 2/69.5 |
| 5,046,204 | A * | 9/1991 | Mohler | 5/494 |
| 5,956,768 | A * | 9/1999 | Pearson | 2/69.5 |
| 5,970,542 | A * | 10/1999 | Mays | 5/485 |
| 6,643,870 | B2 * | 11/2003 | Bertrand | 5/482 |
| 7,581,259 | B2 * | 9/2009 | Thompson | 2/69.5 |
| 2001/0032360 | A1 * | 10/2001 | Bertrand | 5/482 |
| 2002/0129445 | A1 * | 9/2002 | Deering et al. | 5/482 |
| 2003/0061659 | A1 * | 4/2003 | Dunlap et al. | 5/485 |

* cited by examiner

*Primary Examiner* — Peter M Cuomo
*Assistant Examiner* — Brittany Wilson
(74) *Attorney, Agent, or Firm* — Michael D. Eisenberg

(57) ABSTRACT

An insulated pocketed and sock or slippered blanket is provided. The blanket may be used to quickly warm hands, arms, legs and feet with ease requiring no wires or electricity as with electric blankets. The design of the blanket allows the user to place their legs, feet, arms and hands into insulated and padded pockets and thus ensure that extremities remain warm. The present invention includes a blanket for warming extremities comprising: an arm warmer; a leg pocket configured for receiving legs; and two foot warmers.

7 Claims, 5 Drawing Sheets

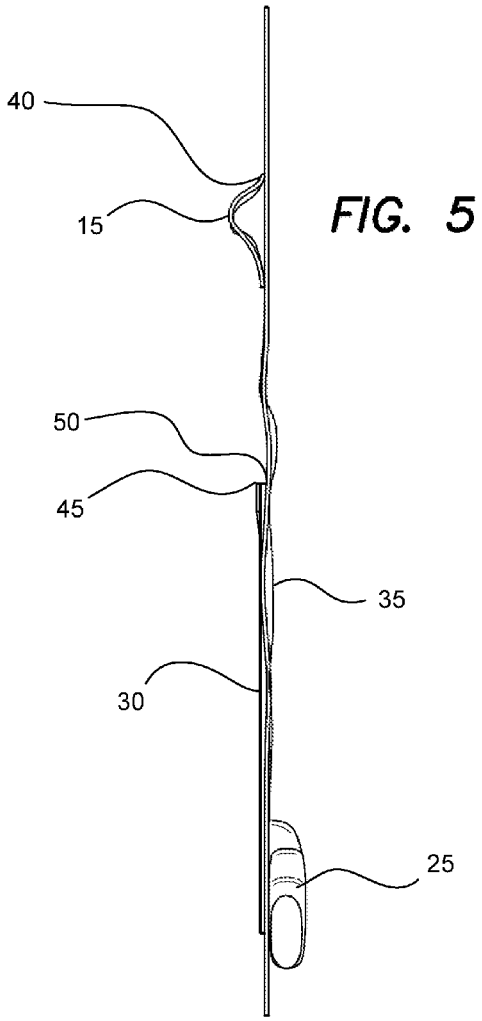
FIG. 5
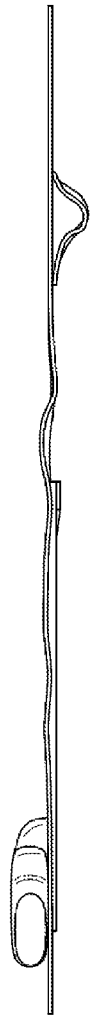
FIG. 6
FIG. 7
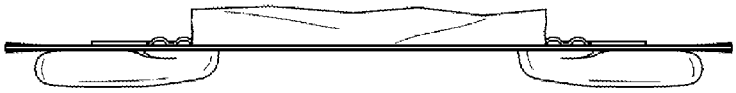
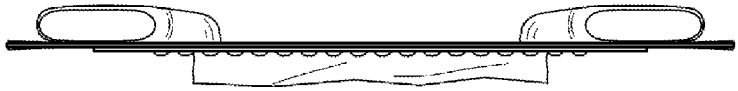
FIG. 8

EXTREMITY WARMING BLANKET

CROSS-REFERENCES TO RELATED APPLICATIONS

The present application claims priority from U.S. Provisional Application Ser. No. 61/419,837 filed on Dec. 5, 2010, which is hereby incorporated herein by reference in its entirety.

TECHNICAL FIELD

The present invention, in some embodiments thereof relates to a blanket, specifically with regard to an insulated pocketed and slippered blanket, which allows users to insulate and warm extremities.

BACKGROUND OF THE INVENTION

The conventional blanket has kept many warm for centuries. One of the issues with regular blankets is their inability to focus coverage and warmth in the essential problem body parts. Many people suffer cold extremities when falling asleep or relaxing on the couch. This problem causes substantial sleep loss and great discomfort for many. During the winter months this is a very common problem that plagues most of the population. Specifically lower extremities are hard to get warm and keep warm because of the distance from the core. Wearing socks or leg warmers is a common way to meet the shortcomings of blankets. However wearing extra clothing to bed can be very uncomfortable. People tend to wrap themselves into the blanket, specifically their legs and feet to try and mimic leg warmers, socks, slippers or even sleeping bag insulation. An electric blanket has also been used to combat freezing feet and legs, but it requires a power source and is a safety hazard. Accordingly, a need remains for a new non-electric blanket design for bed use, seated use or outdoor use to overcome the above noted shortcomings.

BRIEF SUMMARY OF EMBODIMENTS OF THE INVENTION

In a variant, present invention relates to a blanket for warming extremities comprising: an arm warmer; a leg pocket configured for receiving legs; and two foot warmers.

In another variant of the blanket, the arm warmer and leg pocket are located on an inner side of the blanket, and the two foot warmers are located on the outer side of the blanket.

In a further variant of the blanket, the arm warmer is located on a top end of the blanket.

In yet another variant, the arm warmer is in the shape of a half cylinder.

In still a further variant of the blanket, the arm warmer has a hand pocket inside configured for placement of a wearer's fingers and hands.

In a variant, the leg pocket has an opening located at a mid section of the blanket.

In another variant of the blanket, the leg pocket is wider than three quarters the width of the blanket.

In a further variant, the leg pocket is padded with an insulating material.

In yet another variant of the blanket, the leg pocket has an elastic opening which biases the mid section of the blanket inward.

In still a further variant, the foot warmers comprise sleeves conforming to the contours of a foot and have an opening inside of the leg pocket and extends out on the outer side of the blanket.

In another variant of the blanket, the arm warmer comprises two openings each facing perpendicularly to the opening of the leg pocket, the two openings being on opposite ends of the arm warmer and the openings leading to an insulated passageway configured for receiving hands and arms of a wearer.

In yet a further variant, the leg pocket begins around the middle of the blanket and is the same width as the blanket.

In a variant, the leg pocket is padded with an insulating material including, but not limited to wool, cotton or any other clothed material.

In another variant, the leg pocket is lined with elastic to maximize insulation around lower thighs and behind the knees.

In a further variant, the inside of the slipper/socks is made of thick cloth including, but not limited to polyester, cotton or other clothed material.

Optionally, the blanket can come in single size and couple size.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

FIGS. 5 and 6 are side views of the extremity warming blanket;

FIG. 7 is a top view of the extremity warming blanket; and

FIG. 8 is a bottom view of the extremity warming blanket.

Figure 1:
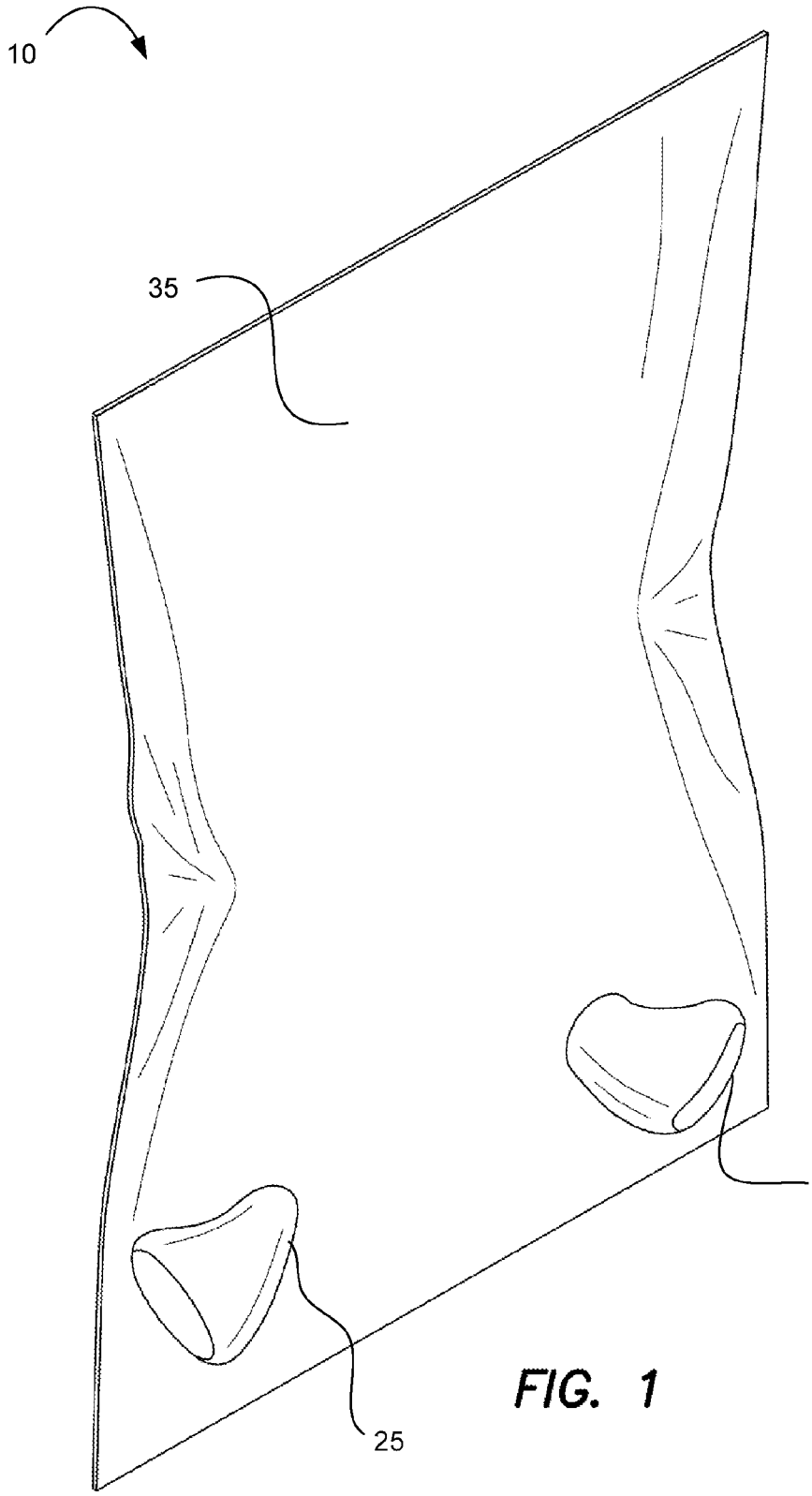
FIG. 1 is a perspective view of an extremity warming blanket.
Figure 2:
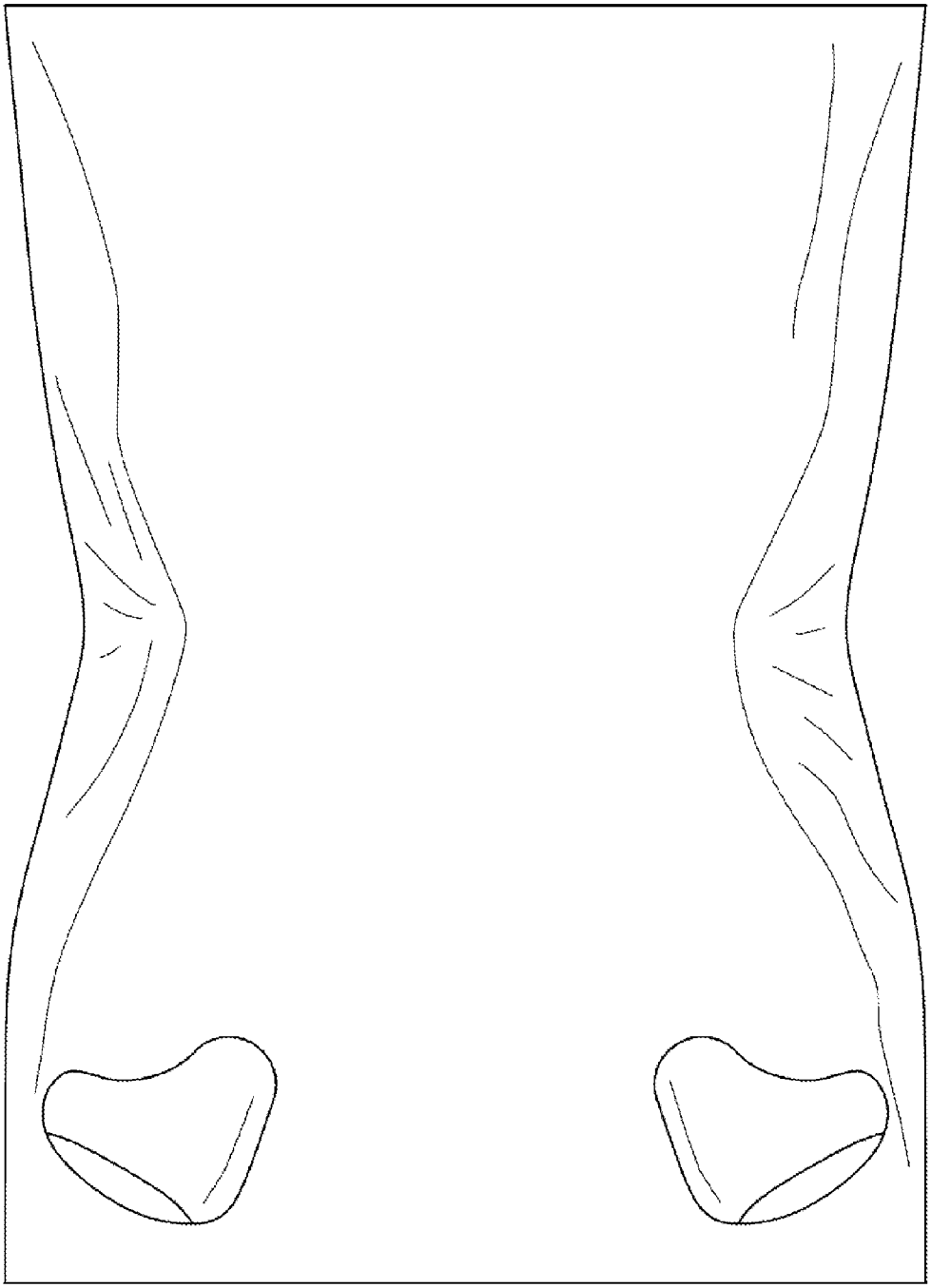
FIG. 2 is a front view of an outer side of the extremity warming blanket.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

The present invention may be used to cover a wearer and for a wearers arms to be slid into an arm pocket, and legs and feet to be slid into a legging pouch and attached socks or slippers for insulated warmth of extremities. The blanket may be for single size and a couple size. The ease of slipping into and out of the legging pouch and footings is to accommodate the sudden increase and decrease in temperature.

The present invention relates to an extremity warming blanket by providing an insulated pocket and slippered blanket. This allows the user to slide their arms into an extra-insulated cylinder arm pocket. The arm warmer is located near the chest area of the user on the underside of the blanket that fits their arms in and across the chest. Inside the cylinder arm warmer pocket is small hand pocket to place cold fingers and hands into. On the underside beginning in the middle of the blanket is the insulated leg pocket lined with elastic to maximize pocket snugness and insulation around the lower thighs and behind the knees. Toward the bottom of the insulated leg pocket are two openings with elastic heel backings, which allow the user to place their heels into and slide each foot individually into slipper/socks, protruding onto the outer side of the blanket.

Referring to the FIGS. 1-7 in general, the present invention, in some embodiments thereof, relates to a blanket 10 having an arm warmer 15, leg pocket 20 and two foot warmers 25 comprising slippers or socks that allow the user to keep extremities warm.

In a variant, present invention relates to a blanket 10 for warming extremities comprising: an arm and hand warmer 15; a leg pocket 20 configured for receiving legs; and two foot warmers 25.

In another variant of the blanket, the arm warmer and leg pocket are located on an inner side 30 of the blanket, and the two foot warmers are located on the outer side 35 of the blanket.

In a further variant of the blanket, the arm warmer is located on a top end 40 of the blanket.

In yet another variant, the arm warmer 15 is in the shape of a half cylinder.

In still a further variant of the blanket, the arm warmer has a hand pocket inside configured for placement of a wearer's fingers and hands.

In a variant, the leg pocket 20 has an opening 45 located at a mid section 50 of the blanket. The leg pocket is wider than at least three quarters the width of the blanket and is padded with an insulating material. The leg pocket has an elastic opening 45 which biases the mid section 50 of the blanket inward.

Figure 3:
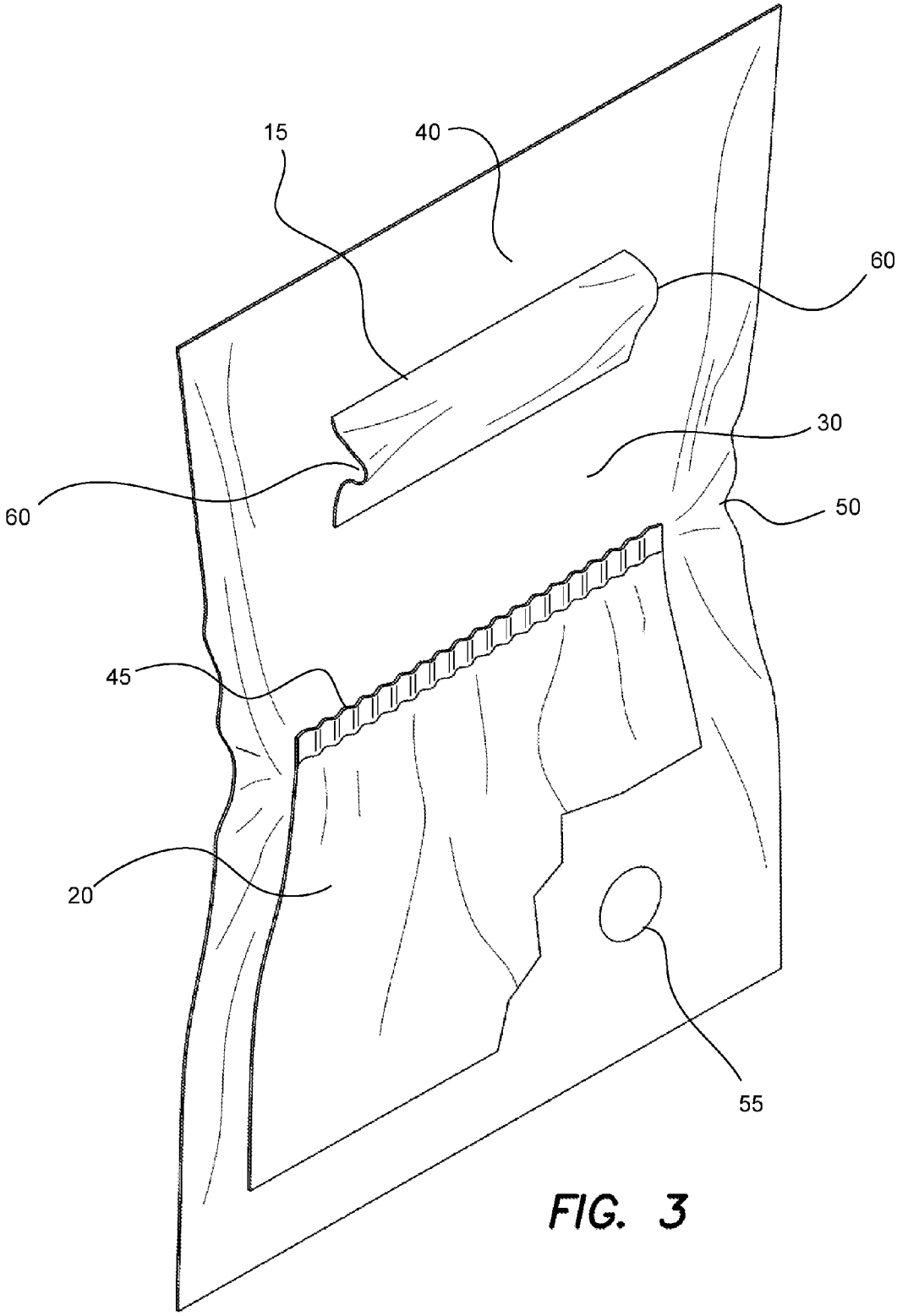
FIG. 3 is a perspective view of an inner side of the extremity warming blanket showing a partial broken view of a leg pocket.
Figure 4:
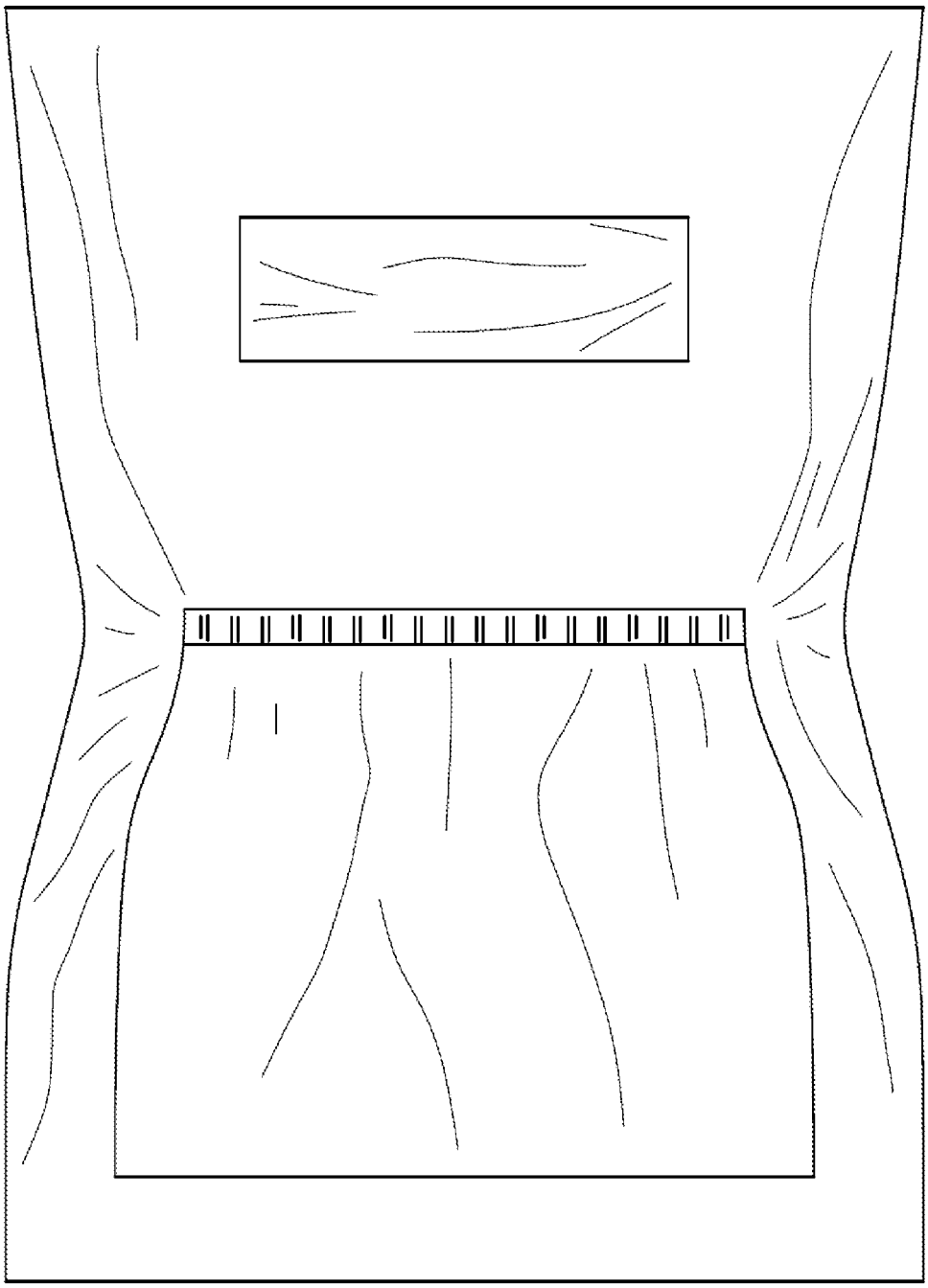
FIG. 4 is the front view of the inner side of the extremity warming blanket.

In still a further variant, referring to FIG. 3 which shows a breakaway view of the leg pocket 20, the foot warmers 25 comprise sleeves conforming to the contours of a foot and have an opening 55 inside of the leg pocket and extend out on the outer side 35 of the blanket 10.

In another variant of the blanket, the arm warmer comprises two openings 60 each facing perpendicularly to the opening 45 of the leg pocket. The two openings 60 are on opposite ends of the arm warmer and the openings 60 lead to an insulated passageway configured for receiving hands and arms of a wearer.

In yet a further variant, the leg pocket begins around the middle of the blanket and is the same width as the blanket.

In a variant, the leg pocket is padded with an insulating material including, but not limited to wool, cotton or any other clothed material.

In another variant, the leg pocket is lined with elastic to maximize insulation around lower thighs and behind the knees.

In a further variant, the inside of the slippers or socks is made of thick cloth including, but not limited to polyester, cotton or other clothed material.

Optionally, the blanket can come in single size and couple size.

In a variant, the blanket may be manufactured of cloth or any such threaded or woven material as would be obvious to one skilled in the art. The foot coverings are more padded and insulated than the exterior blanket. The material to insulate the inside of the foot coverings may be batting or insulation made of wool, cotton or any other clothed material. The inside of the foot coverings may be may be of thick cloth made of polyester, cotton or other clothed material. The elastic leg pocket is open and is the width of the blanket to allow for movement and turning onto your stomach and onto your back while laying down. The foot coverings are preferably not too thick as to cause stiffness like a shoe. The foot coverings may be softly form fitting similar to a really thick material sock. This allows for easy mobility when feet are in the foot coverings and also allows the cover to be used while sitting down.

In use, the insulated pocket and sock or slipper blanket is user friendly. The user simply slides their legs and arms into the arm and leg pouch. Once their legs are in the leggings one can then slip into the slippers or socks for foot warmth. The user can lie under the cover or in foot coverings and slippers. The blanket can also be used sitting down.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A blanket or warming extremities comprising:

a. an arm warmer;

b. a leg pocket configured for receiving legs disposed on an inner of the blanket; and c. two foot warmers having openings disposed inside the leg pocket, the foot warmers comprising sleeves that extend outward and away from the blanket on an outer side of the blanket;

wherein the arm warmer is located on a top end of the blanket; and wherein the leg pocket has an opening located at a mid section of the blanket and wherein the sleeves of the foot warmers are dimensioned in shape to conform to the anatomical configuration of a human foot, comprising a heal portion and toe portion.

2. The blanket of claim 1, wherein the leg pocket is wider than three quarters the width of the blanket.

3. The blanket of claim 2, wherein the leg pocket is padded with an insulating material.

4. The blanket of claim 1, wherein the leg pocket has an elastic opening, wherein the opening biases the mid section of the blanket inward.

5. The blanket of claim 4, wherein the foot warmers comprise sleeves conforming to the contours of a foot, and having an opening inside of the leg pocket and extending out on the outer side of the blanket.

6. The blanket of claim 4, wherein the arm warmer comprises two openings each facing perpendicularly to the opening of the leg pocket, the two openings being on opposite ends of the arm warmer and the openings leading to an insulated passageway configured for receiving hands and arms of a wearer.

7. A blanket for warming extremities comprising:

a. an arm warmer disposed on an inner side of the blanket at a top end, comprising two openings each facing perpendicularly to the opening of the leg pocket and facing sides of the blanket, the two openings being on opposite ends of the arm warmer and the openings leading to an insulated passageway configured for receiving hands and arms of a wearer;

b. a leg pocket disposed on the inner side of the blanket and facing the top of the blanket and configured for receiving a wearer's legs, having an opening located at a mid section of the blanket;

c. two foot warmers comprising sleeves conforming to the contours of a foot, and having an opening inside of the leg pocket and extending out on the outer side of the blanket.

* * * * *